US011371168B2

(12) United States Patent
Son et al.

(10) Patent No.: US 11,371,168 B2
(45) Date of Patent: Jun. 28, 2022

(54) METHOD FOR PRODUCING ANTIMICROBIAL THERMAL AND HEAT-RETAINING FIBER, FIBER PRODUCED BY THE METHOD AND FABRIC USING THE FIBER

(75) Inventors: Hyung-jin Son, Daegu (KR); Jae-hun Jung, Paramus, NJ (US); Tae-won Son, Daegu (KR); Chang-mok Son, Gyeonggi-do (KR)

(73) Assignee: G.CLO INC., Daegu (KR)

( * ) Notice: Subject to any disclaimer, the term of this patent is extended or adjusted under 35 U.S.C. 154(b) by 611 days.

(21) Appl. No.: 13/981,216

(22) PCT Filed: Aug. 14, 2012

(86) PCT No.: PCT/KR2012/006460
§ 371 (c)(1),
(2), (4) Date: May 22, 2014

(87) PCT Pub. No.: WO2014/017690
PCT Pub. Date: Jan. 30, 2014

(65) Prior Publication Data

US 2014/0308504 A1 Oct. 16, 2014

(30) Foreign Application Priority Data

Jul. 25, 2012 (KR) ..... 10-2012-0081154

(51) Int. Cl.
*D01F 1/10* (2006.01)
*D01D 5/08* (2006.01)
*D01F 6/84* (2006.01)

(52) U.S. Cl.
CPC ..... *D01D 5/08* (2013.01); *D01F 1/10* (2013.01); *D01F 1/103* (2013.01); *D01F 1/106* (2013.01);
(Continued)

(58) Field of Classification Search
CPC ..... C08G 63/00; B32B 3/20
(Continued)

(56) References Cited

U.S. PATENT DOCUMENTS 5,180,585 A * 1/1993 Jacobson ..... A01N 25/26 424/404
5,503,840 A * 4/1996 Jacobson ..... A01N 25/26 424/404
(Continued)

FOREIGN PATENT DOCUMENTS

CN 1607270 A 4/2005
CN 101906227 A * 12/2010
(Continued)

OTHER PUBLICATIONS

Machine Translation of JP-07268723 A, Jun. 23, 2015.*
Machine Translation JP-2002363380 A (Year: 2002).*
Machine Translation of KR9104473 B1 (Year: 1991).*

*Primary Examiner* — Jennifer A Boyd
*Assistant Examiner* — Ricardo E Lopez
(74) *Attorney, Agent, or Firm* — Ryan, Mason & Lewis, LLP

(57) ABSTRACT

Disclosed is a method for producing an antimicrobial heat-retaining fiber. The method includes spinning a spinning solution onto a fiber-forming resin. The spinning solution includes 1.0 to 6.0% by weight of carbon particles and 0.2 to 2.0% by weight of a metal alkoxide coupling agent. The spinning solution further includes 0.5 to 3.0% by weight of inorganic particles composed of a metal powder, a ceramic powder, or a mixture thereof By using the metal alkoxide coupling agent, the carbon particles and the inorganic particles are dispersed in a resin. Also disclosed is a fiber produced by the method. The fiber is prevented from breakage during spinning and is imparted with heat-retaining and antimicrobial functions due to the presence of the carbon particles and the inorganic particles. Further disclosed is a fabric manufactured using the fiber. The fabric can be prevented from deterioration of wash fastness.

10 Claims, 2 Drawing Sheets

(52) U.S. Cl.
CPC ..... *D01F 6/84* (2013.01); *Y10T 428/249921* (2015.04)

(58) Field of Classification Search
USPC ..... 428/364
See application file for complete search history.

(56) References Cited

U.S. PATENT DOCUMENTS

| | | | | |
|---|---|---|---|---|
| 6,462,119 | B1 * | 10/2002 | Tsuboi | C08K 3/34 501/128 |
| 2003/0190851 | A1 * | 10/2003 | Yan et al. | 442/123 |
| 2009/0075018 | A1 * | 3/2009 | Ashida et al. | 428/91 |
| 2010/0096769 | A1 * | 4/2010 | Terada | D01D 5/04 264/104 |
| 2011/0047718 | A1 * | 3/2011 | Chen | C08L 67/02 8/494 |

FOREIGN PATENT DOCUMENTS

| | | | | |
|---|---|---|---|---|
| EP | 2266786 | A1 * | 12/2010 | B29C 43/24 |
| EP | 12881833 | | 1/2016 | |
| JP | 07268723 | A * | 10/1995 | |
| JP | H08197659 | A | 8/1996 | |
| JP | 2002363380 | A * | 12/2002 | |
| JP | 2011149122 | A | 8/2011 | |
| KR | 9104473 | B1 * | 6/1991 | |
| KR | 20070110354 | A | 11/2007 | |
| KR | 20090021567 | A | 3/2009 | |
| WO | PCT/KR2012/006460 | | 3/2013 | |

* cited by examiner

METHOD FOR PRODUCING ANTIMICROBIAL THERMAL AND HEAT-RETAINING FIBER, FIBER PRODUCED BY THE METHOD AND FABRIC USING THE FIBER

CROSS-REFERENCE TO RELATED APPLICATIONS

The present application is a national stage application under 35 U.S.C. § 371 that claims priority from International Patent Application No. PCT/KR2012/006460 filed on Aug. 14, 2012 which, itself, claims priority under 35 U.S.C. § 119 from Korean Patent Application No. 10-2012-0081154 filed Jul. 25, 2012, the disclosures of which are incorporated herein by reference in their entireties.

BACKGROUND OF THE INVENTION

1. Field of the Invention

The present invention relates to a method for producing an antimicrobial heat-retaining fiber which includes dispersing carbon particles and inorganic particles in a resin by using a metal alkoxide coupling agent to prepare a spinning solution, a fiber produced by the method that is prevented from breakage during spinning and is imparted with heat-retaining and antimicrobial functions due to the presence of the carbon particles and the inorganic particles, and a fabric manufactured using the fiber that can be prevented from deterioration of wash fastness.

2. Description of the Related Art

Attention has been directed toward the heat retention performance of fiber products and research has long been conducted on the development of heat-retaining fiber products. Heat-retaining effects mainly by thermal insulation have been generally considered to improve the heat retention performance of fiber products. In recent years, thermal storage and heat-retaining materials have been developed. Such materials are based on the conversion and development of the conventional concept of warmth proofing.

Thermal storage and warmth proofing is effected through combinations of studies on ceramics and far-infrared radiation based on conventional synthetic fiber production techniques. Yarn production companies and fiber processing companies are fiercely competing to develop and produce thermal storage and warmth proofing products based on far-infrared radiation.

Heat retention performance is provided for the purpose of developing lightweight, thin, and heat-retaining garments as fiber aggregates. The heat retention performance per unit thickness of such processed products can be improved mainly by adding thermal storage and warmth functions to conventional synthetic fiber products, followed by combination with some factors.

As thermal storage and heat-retaining materials, heat-emitting functional fibers are being currently investigated and developed in which stainless steel superfine fibers as materials capable of producing heat from suitable energy, e.g., electrical energy, are blended with organic fibers (e.g., polyester fibers and aramid fibers) or electrically conducting polymeric materials are included in fibers.

However, the functional fibers are complicated to produce and remain unsatisfactory in terms of durability and fastness, making it difficult to apply to the clothing industry.

Therefore, methods for imparting functionalities to fibers or clothes are almost dependent on post-processing techniques. However, such functionalities are limited in terms of efficacy.

Particularly, post-processing techniques are not suitable to obtain thermal storage and two or more functions at one time. For example, a binder may be used to fixedly attach functional particles to a cloth. This technique has problems in that the amount of the binder is restrictive, which limits the amount of the functional particles attached, and the functional particles are detached from the cloth after washing only a few times, causing loss of their functions.

Another technique for imparting antimicrobial properties to a fiber is known in which an organosilicon quaternary ammonium salt, zirconium phosphate, calcium phosphate, activated alumina, activated carbon, etc. is incorporated into a fiber. The particles are not sufficiently dispersible due to irregular shapes thereof, and as a result, sufficient antimicrobial functions are not obtained. Another disadvantage of the post-processing technique is poor wash fastness. Particularly, the use of a chlorinated detergent causes cloth yellowing.

Many methods for producing fibers with semi-permanent functionalities have been proposed, for example, by adding functional particles to yarns during spinning According to these methods, a molten mixture of functional particles and a resin is spun to allow the functional particles to be chemically bound to the resin, which solves the problem of poor wash fastness.

The size of conventional functional particles is only in the micrometer range, making it difficult to control the diameter of fibers to a desired level. When a mixture of the functional particles with ceramic particles having a size of about 2.0 μm is spun, it is not easy to set suitable spinning conditions in order to adjust the diameter of yarns to less than 3.0 denier.

Further, the functional particles cause yarn breakage during spinning, resulting in poor spinning workability. Accordingly, it is necessary to limit the content of the functional particles in the spinning solution to below a predetermined level. Due to these disadvantages, there is a limitation in imparting functionalities to clothes.

In an attempt to solve the above problems, Korean Patent Publication No. 2011-0123955 discloses a method for producing yarns which includes blending a metal in the form of a colloid or powder having a size of 1 to 10 nm with w-methoxy-poly(oxyethylene/oxypropylene)ether, oxyethylene/oxypropylene, polyalkylene oxide modified polysiloxane, polyethylene glycol, ethylene oxide, 1,2-propylene oxide, Ca-EDTA, Na-EDTA, etc., and melt-spinning the blend together with a resin.

According to this method, the functional inorganic component is bound to the resin in the spinning step to ensure semi-permanent functionalities of the fiber without deterioration of the functionalities despite repeated washing. The metal component is appropriately selected such that the fiber exhibits light-absorbing thermal storage performance, deodorizing performance, and antimicrobial performance.

The use of the metal particles having a small size enables the thickness reduction of the yarns, but when the content of the metal component in the spinning solution exceeds 1% by weight, yarn breakage may be inevitable during spinning.

Therefore, the content of the metal component should be set to less than 1% by weight, and thus there is a limitation in imparting functionalities by the addition of the metal component.

Further, Korean Patent Publication No. 1999-0001108 discloses a method for producing antimicrobial and antifungal polyester multifilament yarns by stirring a micropowder of a bioceramic and polyester chips under heating to allow the microparticles of the bioceramic to be attached to the surface layers of the polyester chips, followed by melt extrusion and spinning. Further, Korean Patent Publication No. 1997-0043390 discloses a method for producing an antimicrobial and antifungal sheath/core type composite fiber. The method includes conjugate spinning an inorganic antimicrobial agent and an organic antimicrobial agent onto polymers constituting a sheath and a core by direct melt extrusion, respectively. Alternatively, the method may include: preparing a high-concentration antimicrobial masterbatch; mixing the masterbatch, constituent polymers of a sheath and a core, an inorganic antimicrobial agent, and an organic antimicrobial agent; melt extruding the mixture; and conjugate spinning the extrudate.

These methods are intended to impart antimicrobial and antifungal efficacies to the fibers and improve the wash fastness of the fibers due to the presence of the antimicrobial agents in the spinning solutions. However, the problem of fiber breakage during spinning remains unsolved, and processing properties (such as dyeability) of the fibers during post-processing are deteriorated.

SUMMARY OF THE INVENTION

The present invention has been made in an effort to solve the above problems, and it is an object of the present invention to provide a method for producing a fiber in which a spinning solution including carbon particles and optionally adding inorganic is used to prevent fiber breakage during spinning while imparting a heat-retaining function or both heat-retaining and antimicrobial functions to the fiber without deterioration of wash fastness.

According to an aspect of the present invention, there is provided a method for producing an antimicrobial heat-retaining fiber, including spinning a spinning solution onto a fiber-forming resin wherein the spinning solution includes 1.0 to 6.0% by weight of carbon particles and 0.2 to 2.0% by weight of a metal alkoxide coupling agent.

The carbon particles are preferably selected from the group consisting of carbon powder particles, graphite powder particles, carbon fiber powder particles, carbon nanotube particles, carbon black particles, and mixtures thereof. The metal alkoxide coupling agent is preferably selected from the group consisting of titanates, aluminates, silicates, and mixtures thereof.

The spinning solution preferably further includes 0.5 to 3.0% by weight of inorganic particles composed of a metal powder, a ceramic powder, or a mixture thereof. The metal powder is more preferably selected from the group consisting of a titanium powder, an aluminum powder, a silver powder, and mixtures thereof. The ceramic powder is more preferably selected from the group consisting of a zinc oxide powder, a titanium oxide powder, an aluminum oxide powder, and mixtures thereof.

The carbon particles or the inorganic particles preferably have a diameter of less than 1 μm.

The spinning solution is preferably prepared by treating the carbon particles or a mixture of the carbon particles and the inorganic particles with the metal alkoxide coupling agent, mixing the treated particles with a resin to prepare a masterbatch, mixing the masterbatch with a fiber-forming resin, and melting the mixture.

The resin mixed with the treated particles to prepare the masterbatch is a polyester copolymer, an epoxy resin, or a mixture thereof The content of the carbon particles, or the mixture of the carbon particles and the inorganic particles in the masterbatch is more preferably from 20 to 30% by weight.

According to another aspect of the present invention, there is provided an antimicrobial heat-retaining fiber produced by the method.

According to yet another aspect of the present invention, there is provided an antimicrobial heat-retaining fabric manufactured using the fiber.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE INVENTION

Figure 1:
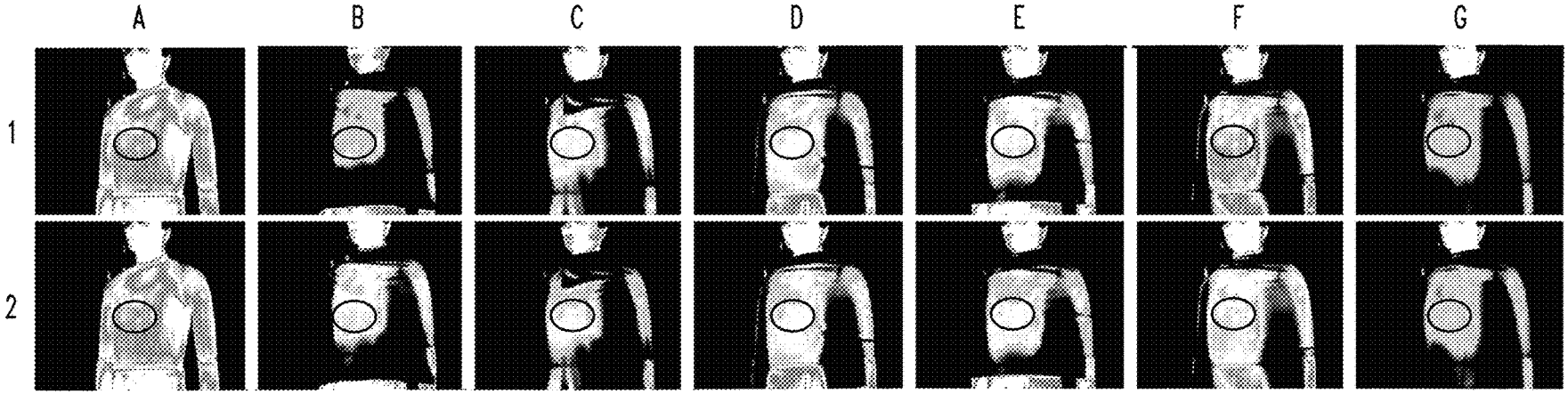
FIG. 1 shows photographs of thermal manikins wearing clothes, taken using a thermal imaging camera.

The present invention provides a method for producing an antimicrobial heat-retaining fiber by mixing, a resin, carbon particles having a heat-retaining function, and a coupling agent chemically binding the carbon particles to a resin, melting the mixture, and spinning the molten mixture. If necessary, inorganic particles having an antimicrobial function may be added to the molten solution. The present invention also provides a fiber produced by the method. In the fiber of the present invention, the carbon particles and the inorganic particles are chemically bound to the resin. The present invention also provides a fabric using the fiber. The fabric of the present invention is prevented from deterioration of wash fastness.

There is no restriction on the kind of the resin. Any resin in the form of a molten solution or a solution that can be spun into a fiber through a spinning nozzle, i.e. any resin that has the ability to form filaments, may be used in the present invention. Examples of resins suitable for use in the present invention include polyester and nylon.

The carbon particles are components that absorb most of the wavelength bands of sunlight, convert the absorbed light into infrared light with heat, and emit radiant heat to the outside. Due to these functions, the carbon particles impart a heat-retaining function to the fiber. Examples of carbon particles suitable for use in the present invention include carbon powder particles, graphite powder particles, carbon fiber powder particles, carbon nanotube particles, and carbon black particles.

The inorganic particles exhibit an antimicrobial function. Examples of inorganic particles suitable for use in the present invention include: metal powder particles, such as titanium powder particles, aluminum powder particles, and silver powder particles; and ceramic powder particles, such as zinc oxide powder particles, titanium oxide powder particles, and aluminum oxide powder particles. These metal powders and ceramic powders may be used alone or as a mixture of two or more thereof.

The metal powders and the ceramic powders may be used alone because they have individual antimicrobial performance. The antimicrobial performance of metal ions increases in the order of Ag>Hg>Cu>Cd>Cr>Pb>Co>Au>Zn>Fe>Mn>Mo>Sn, as reported in the academic literature. The antimicrobial performance of the metal components other than silver is insignificant.

Since some of the metal ions are essential ingredients for the growth of bacteria and fungi, they can be utilized as attractants for bacteria when bound to the antimicrobial materials. Therefore, the metal ions can be mixed with the antimicrobial materials to maximize the antimicrobial performance of the antimicrobial materials.

For example, a mixture of 2% by weight of the ceramic powder and a small amount of the metal powder as an auxiliary material has a bacteriostatic reduction rate of 99% or more against *Staphylococcus aureus, Escherichia coli, Saccharomyces albicans, Salmonella typhimurium,* and other bacteria. When it is intended to obtain an antimicrobial function, a combination of the ceramic powder and the metal powder is more preferred.

The metal alkoxide coupling agent functions to bind the carbon particles/inorganic particles to the resin. The metal alkoxide coupling agent enhances the interfacial adhesion between the resin and the carbon particles/inorganic particles to induce chemical bonding between the resin and the particles.

The metal alkoxide coupling agent may be selected from titanates, aluminates, silicates, and mixtures thereof. The resin is bound to the carbon particles/inorganic particles through coordinate bonds between the resin and the carbon particles/inorganic particles and affinity of the resin for the alkoxide.

The carbon particles and the inorganic particles preferably have a diameter of less than 1 μm, more preferably 20 to 100 nm. If the particles have a diameter larger than 1 μm, chemical bonding of the particles with the resin is hindered, which increases the risk of breakage of the fiber filaments and makes it difficult to reduce the thickness of the fiber filaments.

The content of the carbon particles in the spinning solution is preferably from 1.0 to 6.0% by weight, and the inorganic particles are preferably added in an amount of 0.5 to 3.0% by weight.

If the contents of the carbon particles and the inorganic particles are less than the respective lower limits, negligible heat retention or antimicrobial performance is exhibited. Meanwhile, if the contents of the carbon particles and the inorganic particles exceed the respective upper limits, the fiber may be broken during spinning. When the carbon particles are mixed with the metal powder and the ceramic powder within the ranges defined above, the mixture can be maximally bound to the resin by the action of the metal alkoxide coupling agent while maximizing the desired heat retention and antimicrobial performance.

The content of the metal alkoxide coupling agent in the spinning solution is preferably from 0.2 to 2.0% by weight. If the content of the metal alkoxide coupling agent is less than 0.2% by weight, sufficient bonding between the resin and the carbon particles/inorganic particles is not obtained, which increases the risk that the carbon particles/inorganic particles may be detached from the fiber by repeated washing. Meanwhile, if the content of the metal alkoxide coupling agent exceeds 2.0% by weight, the relative low contents of the carbon particles and the inorganic particles may lead to poor heat-retaining and antimicrobial properties of the fiber.

As described above, the antimicrobial heat-retaining fiber of the present invention can be produced by mixing the resin, the carbon particles, the inorganic particles, and the metal alkoxide coupling agent, melting the mixture to prepare the spinning solution, and spinning the spinning solution. Alternatively, the antimicrobial heat-retaining fiber of the present invention may be produced by the following procedure. First, the carbon particles, or a mixture of the carbon particles and the inorganic particles are treated with the metal alkoxide coupling agent. Thereafter, the treated particles are mixed with the resin to prepare a masterbatch, which is then mixed with a fiber-forming resin, such as PET or nylon. Finally, the mixture is melted and spun. In this case, the carbon particles or the inorganic particles are present at a high concentration in the fiber while preventing fiber breakage during spinning.

The use of the masterbatch improves dilution, dispersibility, filterability, spinnability, uniformity, etc. of the particles to make the particles uniformly dispersible in the spinning solution. This enables the production of the fiber in which the carbon particles and the inorganic particles are uniformly dispersed at high concentrations without the occurrence of fiber breakage during spinning.

The resin mixed with the treated particles to prepare the masterbatch is preferably a low melting point carrier resin, such as a polyester copolymer or an epoxy resin, which is advantageous in terms of uniformity. The content of the carbon particles, or the mixture of the carbon particles and the inorganic particles in the masterbatch is determined taking into consideration the dispersibility of the particles, and is suitably from 20 to 30% by weight.

The fiber is imparted with heat-retaining and antimicrobial functions due to the presence of the carbon particles and the inorganic particles. In the fabric manufactured using the fiber, the carbon particles and the inorganic particles are chemically bound to the resin component. Therefore, the particles can be prevented from being detached from the fiber despite repeated washing, and as a result, the heat-retaining and antimicrobial functions thereof can be maintained for a long time.

The present invention will be explained in more detail with reference to the following examples, including comparative examples and test examples.

However, these examples are given for illustrative purposes only and are not intended to limit the invention. Therefore, those skilled in the art will appreciate that various substitutions and equivalents are possible without departing from the spirit and scope of the present invention.

Examples 1 to 15

A PET resin was fed into a main feeder of an extruder, and 0.5 wt % of a titanium alkoxide and carbon particles/inorganic particles were fed through a side feeder. The amounts of the carbon particles/inorganic particles are shown in Table 1. The resin, the titanium alkoxide, and the particles were melt-mixed in the extruder at high temperature to prepare a spinning solution. The spinning solution was melt-spun at a rate of 4000 m/min through a spinneret to produce a fiber having a fineness of 2 denier.

TABLE 1

| Compositions of carbon particles and inorganic particles in spinning solutions (wt %) | | | | | | | |
|---|---|---|---|---|---|---|---|
| | Carbon powder | Zinc oxide | Titanium oxide | Aluminum oxide | Titanium | Silver | Aluminum |
| Example 1 | 1 | — | — | — | — | — | — |
| Example 2 | 1 | 1 | — | — | — | — | — |
| Example 3 | 1 | — | 1 | — | — | — | — |
| Example 4 | 1 | — | — | 1 | — | — | — |
| Example 5 | 1 | — | — | — | 1 | — | — |
| Example 6 | 1 | — | — | — | — | 1 | — |
| Example 7 | 1 | — | — | — | — | — | 1 |
| Example 8 | 1 | 1 | — | — | — | — | 1 |
| Example 9 | 2 | — | — | — | — | — | — |
| Example 10 | 2 | 1 | — | — | — | — | 1 |
| Example 11 | 3 | 1 | — | — | — | — | 1 |
| Example 12 | 4 | 1 | — | — | — | — | 1 |
| Example 13 | 5 | 1 | — | — | — | — | 1 |
| Example 14 | 6 | 1 | — | — | — | — | 1 |
| Example 15 | 6 | 2 | — | — | — | — | 1 |

When the total content of the inorganic powders in the spinning solution was 10 wt %, fiber breakage occurred and spinning was stopped.

Test Example 1

Measurement of Heat Retention Performance

Each of the fibers of Examples 1-15 was woven into a fabric. After the fabric was exposed to light from an incandescent bulb for 15 min, the light exposure was stopped. The temperatures of the fabric were measured with the passage of time under the following conditions.

Commercially available heat-retaining fabrics were used as controls. The results are shown in Tables 2 and 3.

1) Chamber: EBR(Walk-in Type), Espec
2) Humidity and Temperature logger: LT-88, Gram
3) Heating Element: Light bulb (IWASAKKI Co., 220V/500W/3200K)
4) Light Exposure Distance: 30 cm
5) Light Exposure Side: Surface
6) Measuring Side: Back Side
7) Temperature: 20±2° C.
8) Relative Humidity: 65±4% RH

TABLE 2

| Temperatures before and after light exposure (° C.) | | | | | | | | | |
|---|---|---|---|---|---|---|---|---|---|
| | Light exposure time (min) | | | | | | | | |
| | 0 | 1 | 2 | 3 | 5 | 7 | 10 | 13 | 15 |
| Example 1 | 26.5 | 36.4 | 41.3 | 43.6 | 46.8 | 49.2 | 57.1 | 59.6 | 61.5 |

TABLE 2-continued

| Temperatures before and after light exposure (° C.) | | | | | | | | | |
|---|---|---|---|---|---|---|---|---|---|
| | Light exposure time (min) | | | | | | | | |
| | 0 | 1 | 2 | 3 | 5 | 7 | 10 | 13 | 15 |
| Example 2 | 27.2 | 35.4 | 39.6 | 41.4 | 44.4 | 45.7 | 55.7 | 56.8 | 57.5 |
| Example 3 | 27.7 | 35.8 | 40.0 | 41.9 | 45.2 | 46.5 | 56.1 | 57.3 | 58.4 |
| Example 4 | 27.0 | 35.5 | 40.3 | 42.2 | 45.7 | 46.3 | 55.9 | 56.7 | 57.8 |
| Example 5 | 29.2 | 43.6 | 46.8 | 49.2 | 51.3 | 52.8 | 55.2 | 58.8 | 59.7 |
| Example 6 | 28.1 | 42.4 | 46.0 | 48.0 | 50.9 | 52.6 | 54.9 | 59.0 | 59.2 |
| Example 7 | 27.6 | 41.3 | 45.6 | 47.0 | 49.6 | 51.1 | 54.3 | 58.5 | 59.0 |
| Example 8 | 23.7 | 37.0 | 42.4 | 45.5 | 48.5 | 50.2 | 56.3 | 57.8 | 58.2 |
| Example 9 | 27.4 | 39.5 | 44.8 | 47.2 | 51.0 | 52.5 | 61.7 | 63.7 | 64.6 |
| Example 10 | 27.6 | 38.7 | 43.2 | 46.4 | 50.2 | 51.0 | 59.3 | 60.7 | 61.3 |
| Example 11 | 27.5 | 39.9 | 44.6 | 48.5 | 52.3 | 53.4 | 60.2 | 61.4 | 62.3 |
| Example 12 | 28.4 | 40.3 | 45.2 | 49.3 | 53.4 | 55.0 | 61.7 | 62.4 | 63.1 |
| Example 13 | 28.3 | 40.5 | 46.3 | 49.6 | 54.1 | 56.8 | 62.4 | 63.2 | 63.7 |
| Example 14 | 28.8 | 40.9 | 46.7 | 50.4 | 55.0 | 57.9 | 63.7 | 64.4 | 64.9 |
| Example 15 | 28.9 | 40.9 | 43.6 | 45.0 | 47.4 | 48.8 | 51.0 | 53.6 | 54.5 |
| Control 1 | 24.1 | 30.0 | 33.4 | 34.7 | 36.3 | 37.8 | 41.0 | 42.4 | 43.4 |
| Control 2 | 28.0 | 33.3 | 35.6 | 36.8 | 38.5 | 39.9 | 41.2 | 42.3 | 42.9 |
| Control 3 | 28.1 | 33.3 | 35.3 | 36.4 | 38.0 | 39.5 | 41.0 | 42.3 | 43.0 |

Control 1: Cabelas
Control 2: Champion
Control 3: Kapa

TABLE 3

| Temperatures after light blocking (° C.) | | | | | | | | |
|---|---|---|---|---|---|---|---|---|
| | Time after light blocking (min) | | | | | | | |
| | 1 | 2 | 3 | 4 | 5 | 7 | 10 | 15 |
| Example 1 | 47.2 | 39.0 | 36.5 | 34.8 | 33.2 | 32.0 | 30.7 | 29.5 |
| Example 2 | 43.9 | 37.6 | 35.0 | 34.5 | 33.6 | 32.3 | 31.0 | 29.9 |
| Example 3 | 44.2 | 38.6 | 36.4 | 34.7 | 33.6 | 32.9 | 31.8 | 30.3 |
| Example 4 | 45.1 | 38.9 | 36.9 | 35.1 | 34.0 | 33.2 | 32.5 | 30.7 |
| Example 5 | 45.9 | 40.2 | 37.7 | 36.0 | 35.1 | 33.8 | 32.0 | 30.6 |
| Example 6 | 45.5 | 39.5 | 36.7 | 35.5 | 34.3 | 33.2 | 31.7 | 30.1 |
| Example 7 | 45.1 | 39.0 | 35.4 | 35.1 | 33.9 | 32.7 | 31.2 | 29.5 |
| Example 8 | 46.5 | 39.5 | 36.0 | 34.3 | 33.3 | 32.7 | 31.3 | 29.8 |
| Example 9 | 49.0 | 40.7 | 37.3 | 35.6 | 34.6 | 33.1 | 31.7 | 30.5 |
| Example 10 | 48.7 | 41.4 | 37.6 | 35.9 | 35.0 | 34.1 | 32.7 | 31.0 |
| Example 11 | 49.2 | 42.0 | 38.5 | 36.7 | 35.8 | 34.7 | 33.0 | 31.3 |
| Example 12 | 50.5 | 43.1 | 40.8 | 38.1 | 36.4 | 35.4 | 33.3 | 31.5 |
| Example 13 | 51.5 | 45.3 | 41.7 | 39.8 | 37.0 | 36.1 | 33.7 | 31.8 |
| Example 14 | 52.7 | 46.8 | 43.4 | 40.6 | 37.7 | 36.5 | 33.9 | 31.9 |
| Example 15 | 46.7 | 41.5 | 39.1 | 37.7 | 36.5 | 35.3 | 33.8 | 32.1 |
| Control 1 | 37.0 | 34.5 | 33.0 | 32.0 | 31.3 | 30.4 | 29.4 | 28.3 |
| Control 2 | 37.9 | 35.5 | 34.2 | 33.3 | 32.7 | 31.8 | 30.6 | 28.4 |
| Control 3 | 37.7 | 35.3 | 34.1 | 33.2 | 32.6 | 31.7 | 30.6 | 28.5 |

As can be seen from Tables 2 and 3, the fabrics of Examples 1-9, in which the carbon powder only was present and none of the metal powder or the ceramic powder were present, experienced the highest temperature rises during light exposure and the greatest temperature drops after light blocking. The fabric of Example 8 in which 1 wt % of the carbon powder was mixed with the metal powder and the ceramic powder, and the fabric of Example 15 in which the largest amount (6 wt %) of the carbon powder was mixed with the largest amounts of the metal powder and the ceramic powder, experienced the lowest temperature rises. From these results, it is believed that the metal powder or the ceramic powder reduced the temperature changes resulting from the light exposure and blocking.

As the carbon powder content increased (Examples 10-14), the temperatures were further increased by light exposure and remain high even at 15 min after light blocking. These results reveal that the heat retention performance of the fibers was improved with increasing carbon powder content.

Overall, the fabrics of Examples 1-15 reached higher temperatures after light exposure and were maintained at higher temperatures even after light blocking than the control fabrics. These results demonstrate improved heat retention performance of the fibers of Examples 1-15 and the fabrics using the fibers.

Test Example 2

Test on Thermal Manikins Wearing Clothes

In this example, the fiber of Example 7 was used. The fiber was produced by spinning a spinning solution composed of 97.5 wt % of the PET resin, 1 wt % of the carbon powder, 1 wt % of the aluminum powder, and 0.5 wt % of the titanium alkoxide. A shirt was manufactured using the fiber.

Shirts were manufactured using commercially available heat-retaining fabrics and were used as controls. After the shirts were worn on thermal manikins equipped with internal heaters, changes in the surface temperature of the shirts were measured with the passage of time. The results are shown in Table 4.

The temperatures were measured under ambient conditions (20 ° C. and 65% RH).

TABLE 4

Temperatures after wearing on thermal manikins (° C.)

| | | Time after wearing (min) | | | | | |
|---|---|---|---|---|---|---|---|
| | | 1.7 | 3.3 | 5.0 | 6.7 | 8.1 | 10.0 |
| Manikin | max. | 31.38 | — | — | — | — | — |
| | min. | 29.08 | — | — | — | — | — |
| | avg. | 30.46 | — | — | — | — | — |
| Example 7 | max. | 29.66 | 29.86 | 31.07 | 31.05 | 30.67 | 30.86 |
| | min. | 26.51 | 26.91 | 27.95 | 28.67 | 28.37 | 28.83 |
| | avg. | 28.73 | 28.98 | 30.06 | 30.19 | 29.87 | 30.02 |
| Control 1 | max. | 30.68 | 30.80 | 30.14 | 30.50 | 30.10 | 30.57 |
| | min. | 28.69 | 28.44 | 28.09 | 28.29 | 28.03 | 28.33 |
| | avg. | 29.77 | 29.76 | 29.39 | 29.54 | 29.22 | 29.48 |
| Control 2 | max. | 30.61 | 30.42 | 30.34 | 30.24 | 29.90 | 29.93 |
| | min. | 28.44 | 28.26 | 28.39 | 28.14 | 27.56 | 27.51 |
| | avg. | 29.45 | 29.25 | 29.36 | 29.16 | 28.87 | 28.88 |
| Control 3 | max. | 30.84 | 30.84 | 30.83 | 30.50 | 30.62 | 30.34 |
| | min. | 28.79 | 28.85 | 28.51 | 28.56 | 28.51 | 28.54 |
| | avg. | 29.85 | 29.86 | 29.75 | 29.51 | 29.63 | 29.64 |
| Control 4 | max. | 31.55 | 31.01 | 31.06 | 30.42 | 30.79 | 30.44 |
| | min. | 29.13 | 28.67 | 29.24 | 28.68 | 28.78 | 28.31 |
| | avg. | 30.40 | 30.04 | 30.31 | 29.80 | 29.95 | 29.54 |

TABLE 4-continued

Temperatures after wearing on thermal manikins (° C.)

| | | Time after wearing (min) | | | | | |
|---|---|---|---|---|---|---|---|
| | | 1.7 | 3.3 | 5.0 | 6.7 | 8.1 | 10.0 |
| Control 5 | max. | 29.13 | 28.92 | 28.92 | 28.74 | 29.25 | 29.14 |
| | min. | 27.42 | 27.07 | 27.39 | 27.20 | 27.54 | 27.35 |
| | avg. | 28.21 | 27.90 | 28.12 | 27.99 | 28.33 | 28.09 |

Control 1: Commercial polymer fabric
Control 2: GC-126-007 "Bio Cooltek 7"
Control 3: GC-126-008 "Bio Cooltek 8"
Control 4: GC-126-005 HEATEK5 (C2)
Control 5: Double-side knitted raised heat-emitting fabric As can be seen from the results in Table 4, the average temperature of the manikin was 30.46° C., and the average temperature of the shirt of Example 7 was 30.02° C. 10 min after wearing. The temperature difference was 0.44° C. In contrast, the temperature differences between the average temperature of the manikin and the average temperatures of the control shirts were 0.82-2.37° C.

Particularly, the raised fabric was measured to suffer from the largest heat loss. These results indicate that the shirt of Example 7 had the ability to hold heat emitted from the manikin, that is, better heat retention performance than the control shirts.

1.7 min and 8.1 min after wearing clothes, the surface states of the clothes were imaged using a thermal imaging camera. The images are shown in FIG. 1.

In FIG. 1, the numerals 1 and 2 represent the images obtained at 1.7 min and 8.1 min after wearing, respectively, and A, B, C, D, E, F, and G represent the manikin, Example 7, control 1, control 2, control 3, control 4, and control 5, respectively.

The image of the manikin showed the reddest color due to its highest surface temperature, and the image of control 4 was colored red at 1.7 min after wearing due to its relatively high temperature. In the grayscale version of the drawings the color red appears as a dark gray.

8.1 min after wearing, the temperatures were higher in the following order: control 4>Example 7>control 3>control 1>control 2>control 5. The red colors in the images became pale in the same order. In the grayscale version of the drawings the color red appears as a dark gray.

Test Example 3

Test on Humans Wearing Clothes

In this example, the fiber of Example 9 was used. The fiber was produced by spinning a spinning solution composed of 97.5 wt % of the PET resin, 2 wt % of the carbon powder, and 0.5 wt % of the titanium alkoxide. A shirt was manufactured using the fiber.

The shirt using the fiber of Example 9 and the shirt of control 3, which had the highest average temperature after 10 min among the control shirts in Test Example 2, were put on healthy adult males. The surface temperatures of the shirts were measured immediately, 10 min, and 20 min after wearing. The results are shown in Table 5.

The temperatures were measured under the same conditions (20° C., 65% RH) as in Test Example 2.

TABLE 5

| Temperatures after wearing on humans (° C.) | | | | |
|---|---|---|---|---|
| | | After wearing | | |
| | | Immediately | 10 min. | 20 min. |
| Example 9 | max. | 33.01 | 34.43 | 35.32 |
| | min. | 29.69 | 30.48 | 31.17 |
| | avg. | 31.04 | 32.26 | 33.21 |
| Control 3 | max. | 31.98 | 33.77 | 31.30 |
| | min. | 28.85 | 28.96 | 28.78 |
| | avg. | 31.71 | 30.73 | 30.49 |

As can be seen from the results in Table 5, the shirt of Example 9 had higher maximum and minimum temperatures but a lower average temperature than control 3. The reason is believed to be because the temperature of the shirt of Example 9 was more slowly raised from 20° C. as a whole by the body temperature than that of the shirt of control 3 but was more rapidly raised in hot portions of the human and relatively uniformly raised in cold portions of the human.

After 10 min and 20 min, the shirt of Example 9 had higher temperatures than the shirt of control 3. These results reveal that the shirt of Example 9 had the ability to store heat from the human body and keep the heat from dissipating, that is, it had better heat retention performance than the shirt of control 3.

Figure 2:
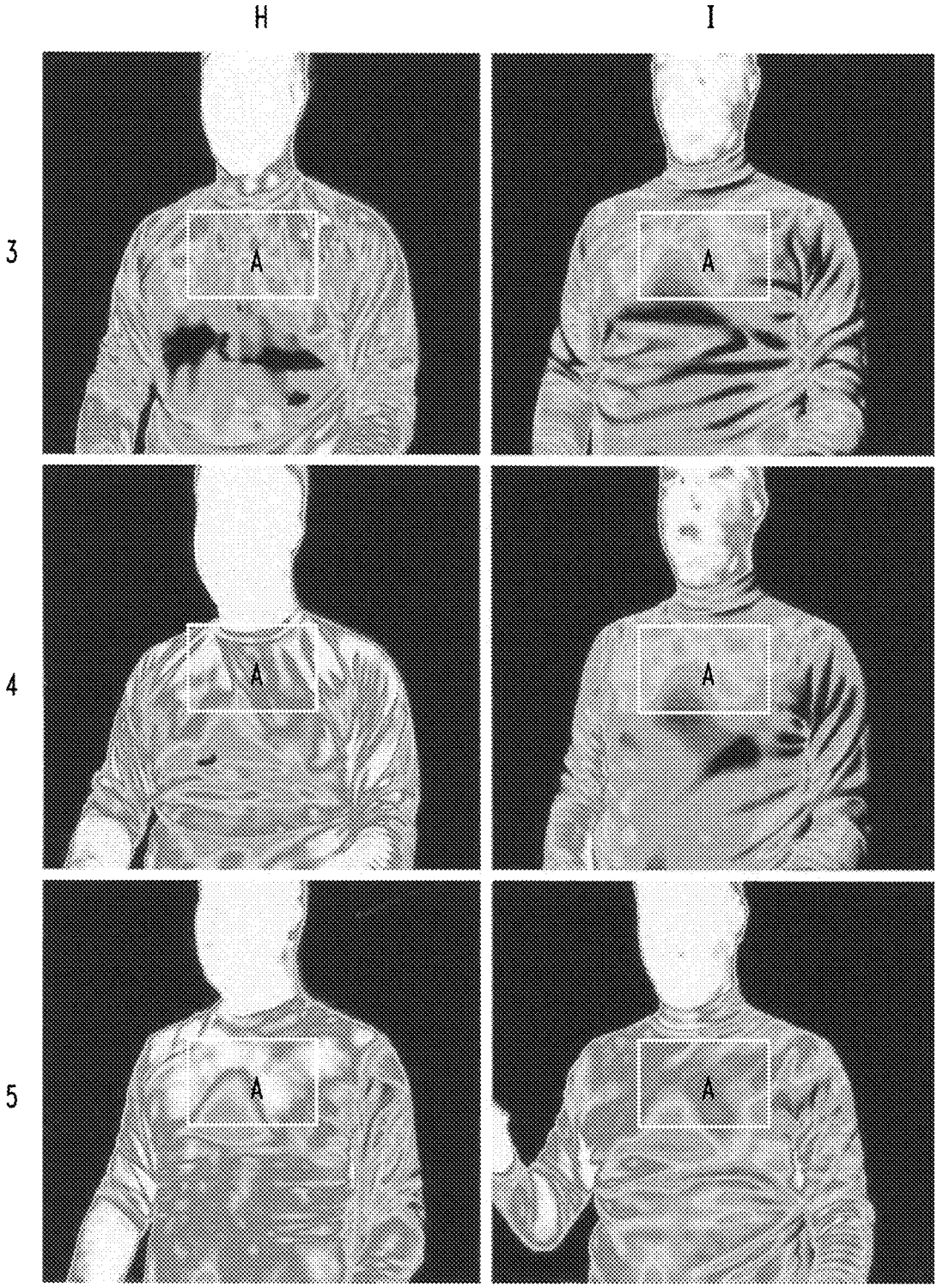
FIG. 2 shows photographs of humans wearing clothes, taken using a thermal imaging camera.

FIG. 2 shows photographs taken using a thermal imaging camera. In FIG. 2, the numerals 3, 4 and 5 represent the images immediately, 10 min, and 20 min after wearing, respectively, and H and G represent the shirt of Example 9 and the shirt of control 3, respectively.

The red colors of the images became deep with the passage of time. Particularly, the colors of Example 9 were deeper red. It is again noted that, in the grayscale version of the drawings the color red appears as a dark gray.

Test Example 4

Antimicrobial Activity Test

Each of the fibers of Example 7, Example 10 and Example 15 was woven into a fabric.

A cotton fabric was used as a control. The antimicrobial properties of the fabrics were tested by the method of KS K 0693:2011. *Staphylococcus aureus* (ATCC 6538) was used as the test strain. The results are shown in Table 6.

TABLE 6

| Antimicrobial test results (cfu/ml) | | | |
|---|---|---|---|
| | Initial | After 18 hrs | Bacteriostatic reduction rate (%) |
| Example 7 | $2.5 \times 10^4$ | $3.8 \times 10^3$ | 99.9 |
| Example 10 | | $3.5 \times 10^3$ | 99.9 |
| Example 15 | | $3.3 \times 10^3$ | 99.9 |
| Control | | $4.4 \times 10^5$ | — |

As can be seen from the results in Table 6, the fabrics of Examples 7, 10, and 15 had a bacteriostatic reduction rate of 99.9%. These results demonstrate excellent antimicrobial activity of the fiber and the fabric of the present invention.

After washing and drying 30 times, the fabrics of Examples 7, 10, and 15 were measured for antimicrobial activity by the same method as described above. As a result, the bacteriostatic reduction rates of the fabrics were maintained at 99.9%. These results indicate that in the fibers produced by the method of the present invention, the carbon particles and the organic particles including the metal powder and the ceramic powder were firmly bound to the resin.

As is apparent from the foregoing, according to the method of the present invention, the carbon particles or the inorganic particles are chemically bound to the resin through the metal alkoxide coupling agent and are thus uniformly dispersed in the spinning solution. Therefore, the antimicrobial heat-retaining fiber of the present invention can be prevented from breakage during spinning. In addition, the fiber of the present invention is imparted with heat-retaining and antimicrobial functions due to the presence of the carbon particles and the inorganic particles therein. Therefore, the fabric of the present invention has good wash fastness without deterioration of heat-retaining and antimicrobial functions despite repeated washing.

What is claimed is:

1. A method for producing an antimicrobial heat-retaining fiber, comprising:

preparing a spinning solution from a mixture comprising:

(i) 0.1 to 2.0% of the spinning solution, by weight, of graphite powder particles, (ii) 0.2 to 2.0% of the spinning solution, by weight, of a metal alkoxide coupling agent selected from the group consisting of one or more silicates, one or more aluminates, one or more titanates, and a mixture thereof, (iii) 0.5 to 3.0% of the spinning solution, by weight, of inorganic particles comprising a mixture of a ceramic powder and a metal powder, wherein the inorganic particles have a diameter of between 20 nanometers and 100 nanometers, and wherein the ceramic powder comprises a zinc oxide powder, and (iv) 89-98.3% or the spinning solution, by weight, of a resin comprising polyethylene terephthalate; and melt-spinning the spinning solution to form the antimicrobial heat-retaining fiber.

2. The method according to claim 1, wherein the metal powder is selected from the group consisting of a titanium powder, an aluminum powder, a silver powder, and mixtures thereof.

3. The method according to claim 1, wherein the graphite powder particles have a diameter of between 20 nanometers and 100 nanometers.

4. An antimicrobial heat-retaining fiber produced by the method according to claim 1.

5. An antimicrobial heat-retaining fabric manufactured using the fiber according to claim 4.

6. The method according to claim 1, wherein the spinning solution further comprises one or more of carbon powder particles, carbon fiber powder particles, carbon nanotube particles, and carbon black particles.

7. The method according to claim 1, wherein the ceramic powder comprises a mixture of (i) the zinc oxide powder, (ii) a titanium oxide powder, and (iii) an aluminum oxide powder.

8. A method for producing an antimicrobial heat-retaining fiber, comprising:

preparing a spinning solution, wherein the spinning solution comprises:

(i) 0.1 to 2.0% of the spinning solution, by weight, of graphite powder particles, (ii) 0.2 to 2.0% of the spinning solution, by weight, of a metal alkoxide coupling agent selected from the group consisting of one or more silicates, one or more aluminates, one or more titanates, and a mixture thereof, and (iii) 0.5 to 3.0% of the spinning solution, by weight, of inorganic particles comprising a mixture of a ceramic powder and a metal powder, wherein the inorganic particles have a diameter of between 20 nanometers and 100 nanometers, and wherein the ceramic powder comprises a zinc oxide powder, and wherein said preparing the spinning solution comprises treating a mixture of the carbon particles and the inorganic particles with the metal alkoxide coupling agent;

creating a masterbatch by mixing (i) the spinning solution with (ii) a resin, wherein the resin comprises a low melting point carrier resin, and wherein the masterbatch comprises (i) 20% to 30%, by weight, of the spinning solution, and (ii) 70% to 80%, by weight, of the resin;

mixing the masterbatch with a fiber-forming resin, wherein the fiber-forming resin comprises polyethylene terephthalate; and forming the antimicrobial heat-retaining fiber by melt-spinning the mixture of the masterbatch and the fiber-forming resin.

9. A method for producing an antimicrobial heat-retaining fiber, comprising:

preparing a spinning solution, wherein the spinning solution comprises:

(i) 0.1 to 2.0% of the spinning solution, by weight, of graphite powder particles, (ii) 0.2 to 2.0% of the spinning solution, by weight, of a metal alkoxide coupling agent selected from the group consisting of one or more silicates, one or more aluminates, one or more titanates, and a mixture thereof, and (iii) 0.5 to 3.0% of the spinning solution, by weight, of inorganic particles comprising a mixture of a ceramic powder and a metal powder, wherein the inorganic particles have a diameter of between 20 nanometers and 100 nanometers, and wherein the ceramic powder comprises a zinc oxide powder, and wherein said preparing the spinning solution comprises treating a mixture of the carbon particles and the inorganic particles with the metal alkoxide coupling agent;

creating a masterbatch by mixing (i) the spinning solution with (ii) a resin, wherein the resin comprises an epoxy resin, and wherein the masterbatch comprises (i) 20% to 30%, by weight, of the spinning solution, and (ii) 70% to 80%, by weight, of the resin;

mixing the masterbatch with a fiber-forming resin, wherein the fiber-forming resin comprises polyethylene terephthalate; and forming the antimicrobial heat-retaining fiber by melt-spinning the mixture of the masterbatch and the fiber-forming resin.

10. The method according to claim 9, wherein the spinning solution further comprises one or more of carbon powder particles, carbon fiber powder particles, carbon nanotube particles, and carbon black particles.

* * * * *